US011713547B2

(12) United States Patent
Lichtberger

(10) Patent No.: US 11,713,547 B2
(45) Date of Patent: Aug. 1, 2023

(54) TAMPING ASSEMBLY FOR A TRACK TAMPING MACHINE

(71) Applicant: HP3 Real GmbH, Vienna (AT)

(72) Inventor: Bernhard Lichtberger, Pregarten (AT)

(73) Assignee: HP3 Real GmbH, Vienna (AT)

( * ) Notice: Subject to any disclaimer, the term of this patent is extended or adjusted under 35 U.S.C. 154(b) by 572 days.

(21) Appl. No.: 16/960,454

(22) PCT Filed: Jan. 8, 2019

(86) PCT No.: PCT/AT2019/050001
§ 371 (c)(1),
(2) Date: Jul. 7, 2020

(87) PCT Pub. No.: WO2019/140466
PCT Pub. Date: Jul. 25, 2019

(65) Prior Publication Data

US 2021/0010206 A1 Jan. 14, 2021

(30) Foreign Application Priority Data

Jan. 22, 2018 (AT) ..... A 50009/2018

(51) Int. Cl.
*E01B 27/16* (2006.01)

(52) U.S. Cl.
CPC ..... *E01B 27/16* (2013.01); *E01B 2203/12* (2013.01)

(58) Field of Classification Search
CPC ..... E01B 27/16; E01B 27/17; E01B 27/20; E01B 35/00; E01B 35/04; E01B 35/10;
(Continued)

(56) References Cited

U.S. PATENT DOCUMENTS 3,981,247 A * 9/1976 Theurer ..... E01B 27/16 104/12
4,068,595 A * 1/1978 Weber ..... E01B 27/16 137/625.22

(Continued)

FOREIGN PATENT DOCUMENTS

AT 339358 B 10/1977
AT 513973 A4 9/2014

(Continued)

OTHER PUBLICATIONS

Espacenet English Language Abstract of DE 2424829, Jan. 8, 1976.

(Continued)

*Primary Examiner* — S. Joseph Morano
*Assistant Examiner* — Cheng Lin
(74) *Attorney, Agent, or Firm* — Tiajoloff & Kelly LLP

(57) ABSTRACT

A tamping assembly (1) for a track tamping machine is proposed comprising tamping tool pairs (3), which are arranged on a girder (7) guided vertically adjustable in a tamping assembly frame and are formed as swing arms, and the lower tamping pick ends (10) of which intended for plunging into a ballast bed (4) are drivable using an oscillation drive and are hydraulically closable toward one another, wherein a hydraulic cylinder (11) and possibly a distance sensor (7) for determining the hydraulic cylinder position are associated with each of the tamping tools (3) of a tamping tool pair, and the hydraulic cylinders (11) form both the linear closing drive and also the oscillation drive of the tamping tools (3), and wherein electrohydraulic valves (25) are provided for actuation of the hydraulic cylinders (11), which comprise a mechanical hydraulic cylinder actuation valve part (12) and an associated valve electronic unit (13). To provide advantageous construction conditions, it is proposed that the valve electronic unit (13) is mounted in a vibration-damped manner by means of vibration dampers
(Continued)

Figure 2:
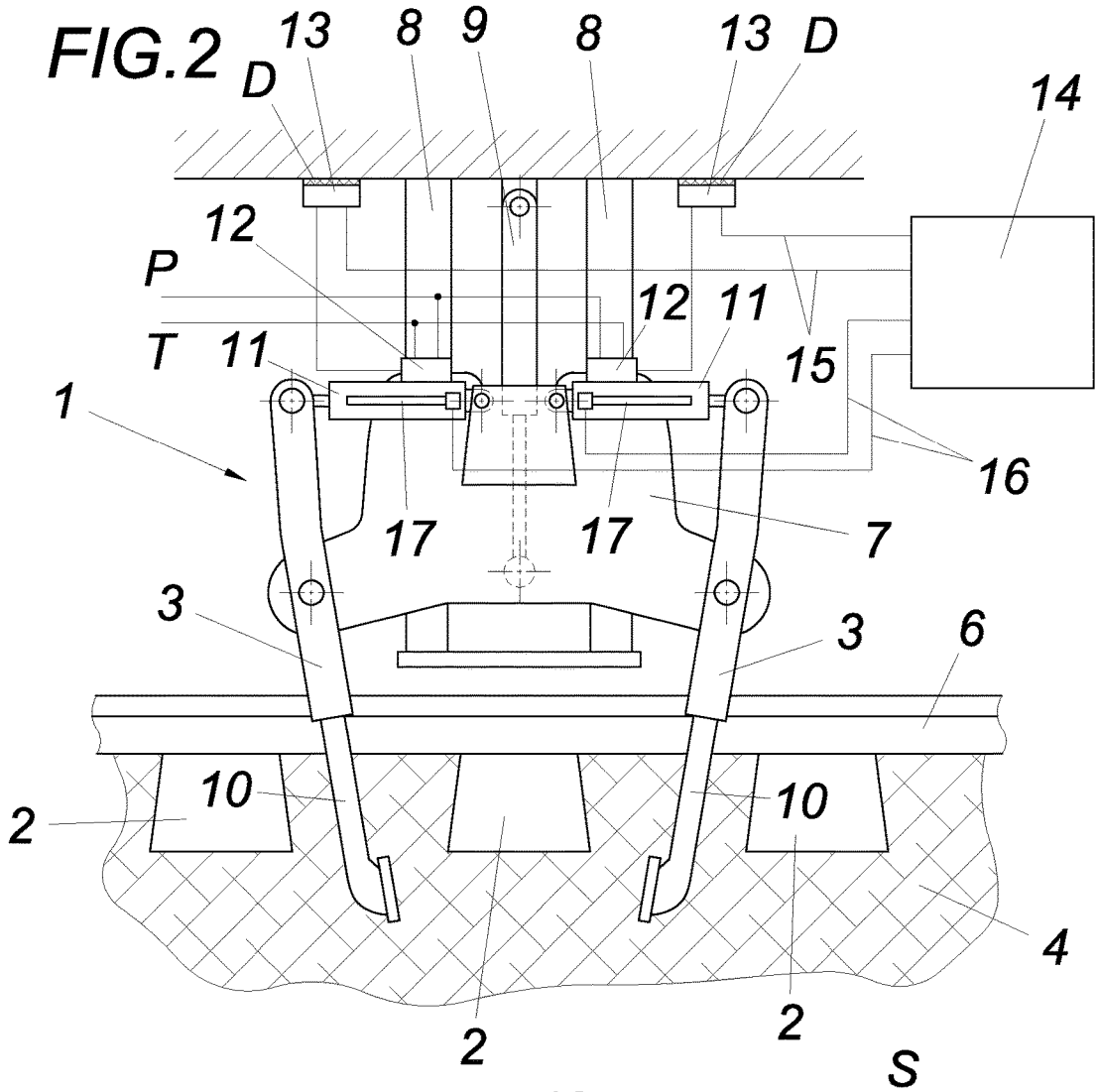

(D) with respect to the hydraulic cylinder (11) and/or the mechanical hydraulic cylinder actuation valve part (12).

19 Claims, 2 Drawing Sheets

(58) Field of Classification Search
CPC ..... E01B 2203/10; E01B 2203/12; E01B 2203/122; E01B 2203/127; E01B 29/00; E01B 29/16; E01B 29/20; B06B 1/18
See application file for complete search history.

(56) References Cited

U.S. PATENT DOCUMENTS

| | | | | |
|---|---|---|---|---|
| 4,130,062 | A * | 12/1978 | Theurer | E01B 27/17 104/7.1 |
| 4,563,953 | A * | 1/1986 | Theurer | E01B 27/16 104/10 |
| 4,942,821 | A | 7/1990 | Rossanigo | |
| 9,957,668 | B2 * | 5/2018 | Lichtberger | E01B 27/16 |
| 9,982,396 | B2 * | 5/2018 | Lichtberger | B06B 1/183 |
| 10,036,128 | B2 | 7/2018 | Salciccia | |
| 10,100,469 | B2 * | 10/2018 | Lichtberger | E01B 27/16 |
| 11,105,047 | B2 * | 8/2021 | Springer | E01B 27/16 |
| 11,179,750 | B2 * | 11/2021 | Philipp | E01B 27/17 |
| 2006/0090666 | A1 * | 5/2006 | Theurer | E01B 27/16 104/12 |
| 2016/0010287 | A1 | 1/2016 | Lichtberger | |
| 2016/0153150 | A1 * | 6/2016 | Salciccia | B06B 1/18 104/12 |

FOREIGN PATENT DOCUMENTS

| | | | |
|---|---|---|---|
| CN | 102031734 | A * | 4/2011 |
| CN | 102031734 | A | 4/2011 |
| DE | 2424829 | A1 | 1/1976 |
| EP | 0331956 | A2 | 9/1989 |
| EP | 1653003 | A2 | 5/2006 |
| EP | 2770108 | A1 | 8/2014 |
| EP | 3026178 | A1 | 6/2016 |
| WO | 2018/041391 | A1 | 3/2018 |

OTHER PUBLICATIONS

Espacenet English Language Abstract of CN102031734, Apr. 27, 2011.
Espacenet English-language Abstract for WO2018/041391 A1, Mar. 8, 2018.

* cited by examiner

TAMPING ASSEMBLY FOR A TRACK TAMPING MACHINE

TECHNICAL AREA

The invention relates to a tamping assembly for a track tamping machine having tamping tool pairs, which are arranged on a girder guided vertically-adjustable in a tamping assembly frame and are formed as rocker arms, and the lower tamping pick ends of which, which are intended to plunge into a ballast bed, are drivable using an oscillating drive and can be hydraulically closed toward one another, wherein a hydraulic cylinder and possibly a distance sensor for determining the hydraulic cylinder position are associated with each of the tamping tools of a tamping tool pair, and the hydraulic cylinders form both the linear closing drive and also the oscillating drive of the tamping tools, and wherein electrohydraulic valves are provided for actuating the hydraulic cylinders, which comprise a mechanic hydraulic cylinder actuation valve part and an associated valve electronic unit.

PRIOR ART

Tamping assemblies penetrate the ballast of a rail bed using tamping tools in the region between two sleepers (divider), in the region of the support of the sleeper in the ballast under the rail, and compact the ballast by way of a dynamic vibration of the tamping picks between the opposing tamping picks, which are closable toward one another. Tamping assemblies can tamp one, two, or more sleepers in one work cycle (DE 24 24 829 A, EP 1 653 003 A2). According to the teaching of EP 1 653 003 A2, the closing drives acting as a linear drive are embodied in such a way that they generate not only a linear closing movement, but rather simultaneously also the vibration required for the tamping picks in a manner known from AT 339 358, EP 0 331 956, or U.S. Pat. No. 4,068,595. The closing speed, the oscillation amplitude, their form, and the frequency can thus be predetermined.

The movements of a tamping assembly comprise the vertical plunging of the tamping picks into the ballast, the closing movement during which the tamping pick ends are closed toward one another, and the overlaid dynamic oscillation which effectuates the actual compaction of the ballast grains. Using hydraulic cylinders for the closing movement, which moreover form the tamping drive, is known (AT513973A).

Optimum tamping frequencies for compaction are known to be between 25-40 Hz, wherein a penetration of the tamping picks into the ballast is possible more easily at higher frequencies, since only a lesser plunging shock occurs and thus the stress of the bearings of the tamping pick assembly can be reduced.

The known solutions of fully hydraulic linear tamping drives (AT513973A), which have a combination of hydraulic cylinder and a control valve constructed directly on the hydraulic cylinder for simultaneously generating the vibration and the closing movement are subjected to high accelerations generated by the vibration. In particular the control valves constructed directly on the cylinder and/or their actuation electronic unit integrated into the valve are thus highly stressed. The lifetime of the valves is thus shortened and the service life decreases. Another disadvantage is that the A, B lines of the hydraulic valve have to be integrated directly into the cylinder as boreholes.

The size and the costs of the special cylinder thus increase. The increasing size of the cylinder is a disadvantage with respect to the constricted space conditions in tamping assemblies. In addition, high pressure variations occur at the pressure lines and tank lines of the control valve, which additionally stress the control valve. These pressure peaks also stress the fittings of the hydraulic lines and the hydraulic lines themselves, on the other hand. This results in a reduction of the lifetime and also in the challenge of keeping the hydraulic screw connections leak-tight in the long term.

DESCRIPTION OF THE INVENTION

The invention is thus based on the object of refining tamping assemblies of the type described at the outset using simple means in such a way that the durability of the fully hydraulic tamping drive is significantly increased.

The invention achieves the stated object in that the valve electronic unit is mounted in a vibration-damped manner with respect to the hydraulic cylinder and/or the mechanic hydraulic cylinder actuation valve part by means of vibration dampers.

The valve electronic unit of the hydraulic control valve is constructed separately from the (electro-)mechanical part of the hydraulic control valve. The valve electronic unit can thus be mounted in a vibration-damped manner with respect to the hydraulic cylinder and/or the mechanical hydraulic cylinder actuation valve part. The vibration-damping mounting can be formed by corresponding rubber-elastic elements, by spring damper elements, or the like. The durability of the fully hydraulic tamping drive is significantly increased by this measure.

The valve electronic unit and the mechanic hydraulic cylinder actuation valve part can also be mounted in a vibration-damped manner with respect to the hydraulic cylinder by means of vibration dampers each as such or jointly.

One possible embodiment of the invention is to arrange the valve electronic unit and possibly the mechanical hydraulic cylinder actuation valve part spaced apart from the hydraulic cylinder, correspondingly in a vibration-damped manner. The mechanical hydraulic cylinder actuation valve part can also be arranged directly on the hydraulic cylinder in a vibration-damped manner by means of vibration dampers. Moreover, there is the option of arranging the valve electronic unit in a vibration-damped manner by means of vibration dampers directly on the mechanical hydraulic cylinder actuation valve part.

Moreover, it is advantageous if a hydraulic accumulator is arranged in a hydraulic pressure supply line to the mechanical hydraulic cylinder actuation valve part and/or if a hydraulic accumulator is installed in a hydraulic tank return line from the mechanical hydraulic cylinder actuation valve part. Wear-promoting pressure peaks can thus be reduced.

A valve constructed separately from the hydraulic cylinder moreover has the advantage according to the invention that a simple cost-effective cylinder of smaller construction can be used. The construction of hydraulic accumulators in the immediate vicinity of the hydraulic control valve reduces the pressure peaks in the hydraulic lines and thus also the stresses of the hydraulic control valve, the seals, the fittings, and the hydraulic lines themselves. The susceptibility to fault is strongly reduced by the vibration-damped mounting of the valve electronic unit, which is susceptible to malfunction.

BRIEF DESCRIPTION OF THE INVENTION

Figure 3:
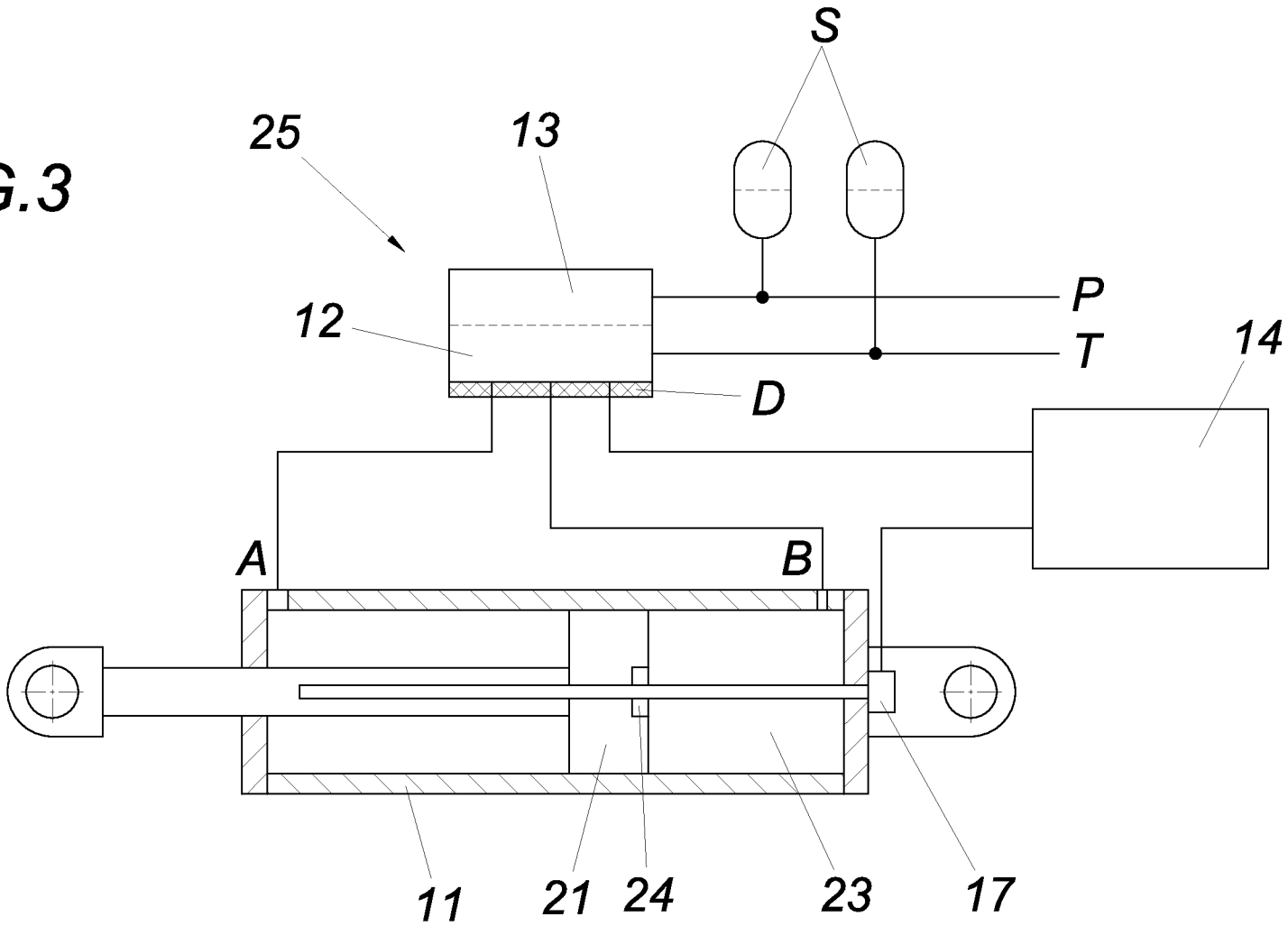

The subject matter of the invention is illustrated by way of example in the drawings. In the figures FIG. 1 schematically shows a fully hydraulic tamping drive in a side view in partial section, FIG. 2 shows a schematic diagram of a tamping assembly having fully hydraulic tamping drive, and FIG. 3 shows a further schematic diagram of a tamping assembly having fully hydraulic tamping drive.

WAYS OF EMBODYING THE INVENTION

Figure 1:
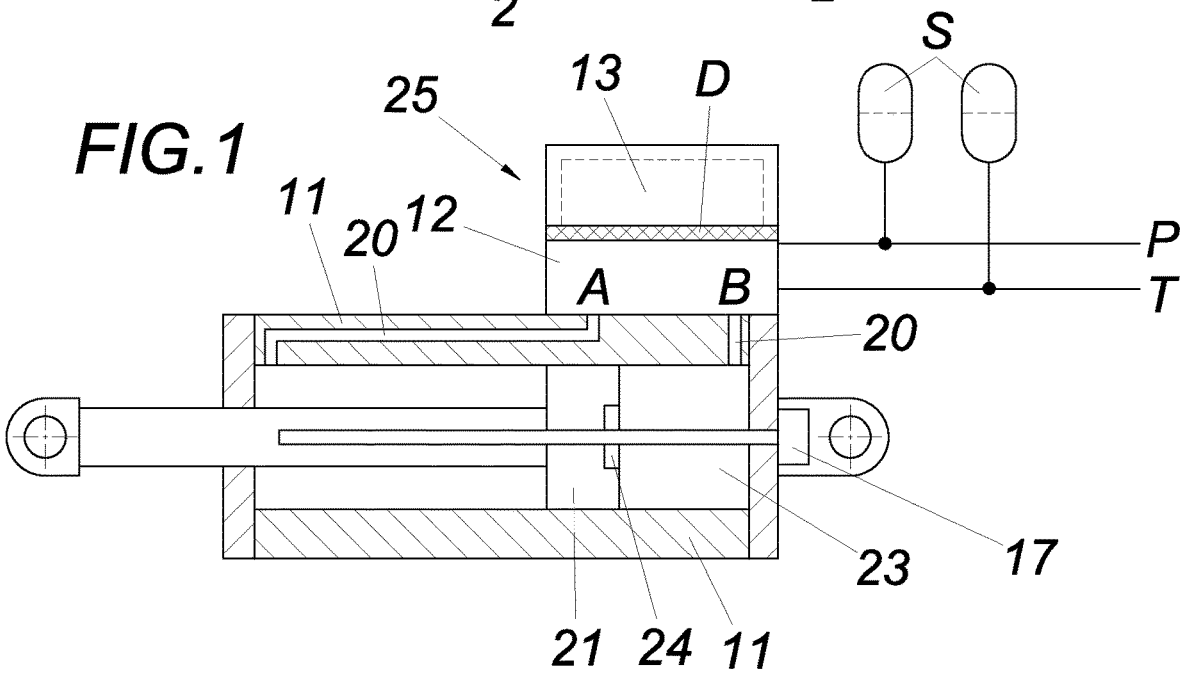

FIG. 1 shows a fully hydraulic linear tamping drive. The hydraulic cylinder 11 has boreholes embedded in the cylinder body, which function as hydraulic supply lines 20 and are supplied directly from the attached valve 25 via connections A, B. Pressurized hydraulic fluid is supplied coming from a hydraulic pump via a hydraulic pressure supply line P to the hydraulic valve 25 and is returned back to a hydraulic tank via a hydraulic tank return line T. A hydraulic accumulator S is arranged in the hydraulic pressure supply line P to the mechanical hydraulic cylinder actuation valve part 12, and also in the hydraulic tank return line T.

A distance sensor 17 is integrated into the hydraulic cylinder 11. An embodiment as an inductive distance sensor is shown here, wherein a position magnet 24 is provided, via which the deflection of the piston 21 is measured. If the cylinder chamber 23 is subjected to pressure P via the connection B, the piston moves to the left. If the pressure application of the piston via the valve 25 changes to the connection A, the piston 21 then moves to the other side. The valve electronic unit (13) is mounted in a vibration-damped manner on the mechanical hydraulic cylinder actuation valve part 12 via vibration dampers (D).

FIG. 2 schematically shows a tamping assembly 1. The tamping assembly 1 for a track tamping machine comprises a tamping tool pair 3, which is arranged on a girder 7 and is formed as swing arms, and the lower tamping pick ends 10 of which intended for plunging into a ballast bed 4 are drivable using an oscillation drive and are hydraulically closable toward one another. A hydraulic cylinder 11 and possibly a distance sensor 17 for determining the hydraulic cylinder position are associated with each of the tamping tools 3 of a tamping tool pair. The distance sensor can also be omitted, however. The hydraulic cylinders 11 form both the linear closing drive and also the oscillation drive of the tamping tools 3. Electrohydraulic valves are provided for actuation of the hydraulic cylinders 11, which comprise a mechanical hydraulic cylinder actuation valve part 12 and an associated valve electronic unit 13. The valve electronic unit 13 is mounted in a vibration-damped manner by means of vibration dampers D with respect to the hydraulic cylinder 11 and/or the mechanical hydraulic cylinder actuation valve part 12. The vibration damper D is indicated as a rubber-elastic bearing in the exemplary embodiment.

During the tamping, the tamping picks plunge into the ballast 4 of a track 1 and compact the ballast 4 under the sleepers 2. The sleepers 2 are fastened on the rails 6. The tamping arms 3 are articulated on the tamping box 7. The tamping box 7 is moved up and down on vertical guides 8 via a drive 9. In the figure, according to the invention, the mechanical hydraulic cylinder actuation valve part 12 is constructed separately from the shock-sensitive valve electronic unit 13. A control and regulation electronic unit 14 is connected to the distance sensors 17 via electrical connecting lines 16. In addition, the valve electronic parts 13 are actuated via the control lines 15. The control valve parts 12 which are directly in the special cylinder 11 are supplied using the pressure line P and the tank line T.

FIG. 3 shows, according to the invention, a hydraulic cylinder 11 shown schematically in section, which is connected via the hydraulic lines A and B to a separate control valve 25 installed in a vibration-resistant manner. The control valve 25 is supplied via the pressure line P and returns the oil into the tank via the tank line T. The pressure peaks on the pressure lines and tank lines are reduced using the hydraulic pressure accumulators S constructed according to the invention.

The invention claimed is:

1. A tamping assembly for a track tamping machine, said tamping assembly comprising:

tamping tool pairs of tamping tools arranged on a girder that is guided so as to be vertically adjustable in a tamping assembly frame and formed as swing arms; and the tamping tool pairs having lower tamping pick ends configured to be plunged into a ballast bed drivable using an oscillation drive and hydraulically closable toward one another;

wherein a hydraulic cylinder associated with each of the tamping tools of a tamping tool pair, and the hydraulic cylinders form both a linear closing drive hydraulically closing the tamping pick ends toward one another and also an oscillation drive driving the tamping tools; and wherein electrohydraulic valves actuate the hydraulic cylinders, wherein the electrohydraulic valves each comprise a mechanical hydraulic cylinder actuation valve part and an associated valve electronic unit, wherein the valve electronic unit is mounted using vibration dampers so as to be vibration-damped with respect to the hydraulic cylinder or the mechanical hydraulic cylinder actuation valve part; and wherein the mechanical hydraulic cylinder actuation valve part is arranged so as to be vibration-damped on the hydraulic cylinder using the vibration dampers.

2. The tamping assembly according to claim 1, wherein both the valve electronic unit and the mechanical hydraulic cylinder actuation valve part are mounted so as to be vibration-damped with respect to the hydraulic cylinder using said vibration dampers.

3. The tamping assembly according to claim 2 wherein the valve electronic unit is arranged spaced apart from the hydraulic cylinder.

4. The tamping assembly according to claim 3 wherein the valve electronic unit is arranged so as to be vibration-damped on the mechanical hydraulic cylinder actuation valve part using the vibration dampers.

5. The tamping assembly according to claim 1, wherein the valve electronic unit is arranged spaced apart from the hydraulic cylinder.

6. The tamping assembly according to claim 5 wherein a distance sensor determines positions of the hydraulic cylinder position.

7. The tamping assembly according to claim 1, wherein a hydraulic accumulator is arranged in a hydraulic pressure supply line to the mechanical hydraulic cylinder actuation valve part.

8. The tamping assembly according to claim 1, wherein a hydraulic accumulator is installed in a hydraulic tank return line from the mechanical hydraulic cylinder actuation valve part.

9. The tamping assembly according to claim 1 wherein a distance sensor determines positions of the hydraulic cylinder position.

10. The tamping assembly according to claim 1 wherein both the valve electronic unit and the mechanical hydraulic cylinder actuation valve part are arranged spaced apart from the hydraulic cylinder.

11. The tamping assembly according to claim 1, wherein the valve electronic unit is arranged so as to be vibration-damped on the mechanical hydraulic cylinder actuation valve part using the vibration dampers.

12. A tamping assembly for a track tamping machine, said tamping assembly comprising:

tamping tool pairs of tamping tools arranged on a girder that is guided so as to be vertically adjustable in a tamping assembly frame and formed as swing arms; and the tamping tool pairs having lower tamping pick ends configured to be plunged into a ballast bed drivable using an oscillation drive and hydraulically closable toward one another;

wherein a hydraulic cylinder associated with each of the tamping tools of a tamping tool pair, and the hydraulic cylinders form both a linear closing drive hydraulically closing the tamping pick ends toward one another and also an oscillation drive driving the tamping tools; and wherein electrohydraulic valves are actuate the hydraulic cylinders, wherein the electrohydraulic valves each comprise a mechanical hydraulic cylinder actuation valve part and an associated valve electronic unit, wherein the valve electronic unit is mounted using vibration dampers so as to be vibration-damped with respect to the hydraulic cylinder or the mechanical hydraulic cylinder actuation valve part; and wherein the valve electronic unit is arranged so as to be vibration-damped on the mechanical hydraulic cylinder actuation valve part using the vibration dampers.

13. The tamping assembly according to claim 12, wherein both the valve electronic unit and the mechanical hydraulic cylinder actuation valve part are mounted so as to be vibration-damped with respect to the hydraulic cylinder using said vibration dampers.

14. The tamping assembly according to claim 12, wherein the valve electronic unit is arranged spaced apart from the hydraulic cylinder.

15. The tamping assembly according to claim 13, wherein the valve electronic unit is arranged spaced apart from the hydraulic cylinder.

16. The tamping assembly according to claim 12, wherein a hydraulic accumulator is arranged in a hydraulic pressure supply line to the mechanical hydraulic cylinder actuation valve part.

17. The tamping assembly according to claim 12, wherein a hydraulic accumulator is installed in a hydraulic tank return line from the mechanical hydraulic cylinder actuation valve part.

18. The tamping assembly according to claim 12 wherein a distance sensor determines positions of the hydraulic cylinder position.

19. A tamping assembly for a track tamping machine, said tamping assembly comprising:

tamping tool pairs of tamping tools arranged on a girder that is guided so as to be vertically adjustable in a tamping assembly frame and formed as swing arms; and the tamping tool pairs having lower tamping pick ends configured to be plunged into a ballast bed drivable using an oscillation drive and hydraulically closable toward one another;

wherein a hydraulic cylinder associated with each of the tamping tools of a tamping tool pair, and the hydraulic cylinders form both a linear closing drive hydraulically closing the tamping pick ends toward one another and also an oscillation drive driving the tamping tools; and wherein electrohydraulic valves are actuate the hydraulic cylinders, wherein the electrohydraulic valves each comprise a mechanical hydraulic cylinder actuation valve part and an associated valve electronic unit, wherein the valve electronic unit is mounted using vibration dampers so as to be vibration-damped with respect to the hydraulic cylinder or the mechanical hydraulic cylinder actuation valve part; and wherein the valve electronic unit is mounted using said vibration dampers so as to be vibration-damped with respect to both the hydraulic cylinder and the mechanical hydraulic cylinder actuation valve part.

* * * * *